US006800411B2

(12) United States Patent
Tong et al.

(10) Patent No.: US 6,800,411 B2
(45) Date of Patent: Oct. 5, 2004

(54) PHOTOCONDUCTIVE IMAGING MEMBERS

(75) Inventors: Yuhua Tong, Webster, NY (US); Jin Wu, Webster, NY (US); Liang-Bih Lin, Webster, NY (US); John F. Yanus, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/369,797

(22) Filed: Feb. 19, 2003

(65) Prior Publication Data

US 2004/0161681 A1 Aug. 19, 2004

(51) Int. Cl.[7] ..... G03G 5/06

(52) U.S. Cl. ..... 430/58.05; 430/58.8; 430/59.4; 430/60; 430/64; 430/65

(58) Field of Search ..... 430/58.05, 58.8, 430/59.4, 60, 64, 65

(56) References Cited

U.S. PATENT DOCUMENTS

| | | | | | |
|---|---|---|---|---|---|
| 4,265,990 | A | | 5/1981 | Stolka et al. | 430/59 |
| 4,555,463 | A | | 11/1985 | Hor et al. | 430/59 |
| 4,587,189 | A | | 5/1986 | Hor et al. | 430/59 |
| 4,921,769 | A | | 5/1990 | Yuh et al. | 430/64 |
| 5,411,827 | A | * | 5/1995 | Tamura et al. | 430/58.05 |
| 5,473,064 | A | | 12/1995 | Mayo et al. | 540/141 |
| 5,482,811 | A | | 1/1996 | Keoshkerian et al. | 430/135 |
| 6,015,645 | A | | 1/2000 | Murti et al. | 430/59 |
| 6,156,468 | A | | 12/2000 | Wehelie et al. | 430/65 |
| 6,177,219 | B1 | | 1/2001 | Yuh et al. | 430/65 |
| 6,255,027 | B1 | | 7/2001 | Wehelie et al. | 430/65 |
| 6,287,737 | B1 | | 9/2001 | Ong et al. | 430/58.8 |
| 6,436,597 | B2 | * | 8/2002 | Maruyama et al. | 430/59.6 |

* cited by examiner

*Primary Examiner*—John L Goodrow
(74) *Attorney, Agent, or Firm*—Eugene O. Palazzo

(57) ABSTRACT

A photoconductive imaging member comprised of a substrate, a photogenerating layer, and a charge transport layer containing a binder and a compound containing at least two (methyl)acrylates.

52 Claims, No Drawings

PHOTOCONDUCTIVE IMAGING MEMBERS

CROSS REFERENCES

There is illustrated in copending U.S. Ser. No. 10/369,816, the disclosure of which is totally incorporated herein by reference, entitled Photoconductive Imaging Members, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in copending U.S. Ser. No. 10/369,812, filed concurrently herewith, the disclosure of which is totally incorporated herein by reference, entitled Photoconductive Imaging Members, a photoconductive imaging member containing a hole blocking layer, a photogenerating layer, a charge transport layer, and thereover an overcoat layer comprised of a polymer with a low dielectric constant and charge transport molecules.

The components, such as photogenerating pigments, charge transport compounds, supporting substrates, hole blocking layers and binder polymers, and processes of the copending applications may be selected for the present invention in embodiments thereof.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II), and water

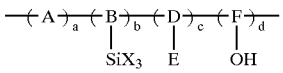

(I)

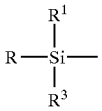

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 250° C, for a period of from about 12 hours to about 1 week, and preferably about 24 hours.

The appropriate components and processes of the above patents may be selected for the present invention in embodiments thereof.

BACKGROUND

This invention is generally directed to imaging members, and more specifically, the present invention is directed to multi-layered photoconductive imaging members with a photogenerating layer, a charge transport layer, an optional hole blocking, or undercoat layer (UCL) and wherein the charge transport layer contains a polymer binder and a compound containing at least two (methyl)acrylates); that is for example, multi-(methyl)acrylate functional monomers or oligomers and which monomers subsequent to polymerization are converted to polymers. The acrylate compound containing at least two, and more specifically, from about 2 to about 200, and yet more specifically, from about 2 to about 50 acrylate groups, and wherein the number of (methyl)acrylates) in the compound yields tunable physical properties for the crosslinked charge transport layers. Yet more specifically a higher number of (methyl)acrylates in one compound will result in a higher crosslinking density or value percentage in the charge transport layer.

The following are structural formulae of typical examples of a compound with at least two (methyl)acrylates group

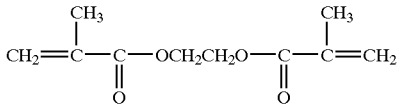

EGDMA

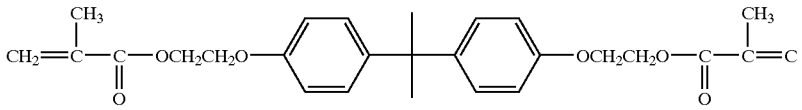

Bis-EMA

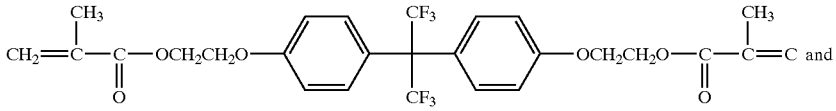

F-bis-EMA

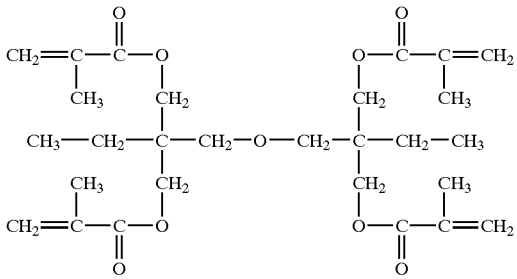

DP-PMA

In embodiments the photogenerating layer can be situated between the charge transport layer and the supporting substrate, and the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, hydroxy gallium phthalocyanines, perylenes, titanyl phthalocyanines, selenium, selenium alloys, azo pigments, squaraines, and the like. The imaging members of the present invention in embodiments exhibit excellent cyclic/environmental stability; excellent wear characteristics; extended lifetimes of, for example, up to 3,000,000 imaging cycles; minimum microcracking; elimination/minimization of adverse affect when contacted with a number of solvents such as methylene chloride, tetrahydrofuran and toluene; acceptable and in some instances improved electrical characteristics; compatibility of the charge transport components with the partially crosslinked (methyl)acrylates; excellent imaging member surface properties; and which members can be economically prepared with tunable or preselected crosslinking percentages, depending on the mechanical and other desired member characteristics.

Processes of imaging, especially xerographic imaging, and printing, including digital, are also encompassed by the present invention. More specifically, the photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 475 to about 950 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an arylamine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The uses of perylene pigments as photoconductive substances are also known. There is thus described in Hoechst European Patent Publication 0040402, DE3019326, filed May 21, 1980, the use of N,N'-disubstituted perylene-3,4,9,10-tetracarboxyldiimide pigments as photoconductive substances. Specifically, there is, for example, disclosed in this publication N,N'-bis(3-methoxypropyl)perylene-3,4,9,10-tetracarboxyl-diimide dual layered negatively charged photoreceptors with improved spectral response in the wavelength region of 400 to 700 nanometers. A similar disclosure is presented in Ernst Gunther Schlosser, *Journal of Applied Photographic Engineering*, Vol. 4, No. 3, page 118 (1978). There are also disclosed in U.S. Pat. No. 3,871,882, the disclosure of which is totally incorporated herein by reference, photoconductive substances comprised of specific perylene-3,4,9,10-tetracarboxylic acid derivative dyestuffs. In accordance with this patent, the photoconductive layer is preferably formed by vapor depositing the dyestuff in a vacuum. Also, there are disclosed in this patent dual layer photoreceptors with perylene-3,4,9,10-tetracarboxylic acid diimide derivatives, which have spectral response in the wavelength region of from 400 to 600 nanometers. Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

SUMMARY

It is a feature of the present invention to provide imaging members with many of the advantages illustrated herein, such as extended lifetimes of over, for example, 3,000,000 imaging cycles; excellent electronic characteristics; stable properties; microcracking, for example, minimal cracks visible with magnification and the like.

Another feature of the present invention relates to the provision of layered photoresponsive imaging members, which are responsive to near infrared radiation of from about 700 to about 900 nanometers.

It is yet another feature of the present invention to provide layered photoresponsive imaging members with sensitivity to visible light.

Moreover, another feature of the present invention relates to the provision of layered photoresponsive imaging members with mechanically robust and solvent resistant charge transport layers.

In a further feature of the present invention there are provided imaging members containing compatible polymers of multifunctional acrylates.

Moreover, in yet another feature of the present invention there are provided imaging members with optional hole blocking polymer layers comprised of titanium oxide and a phenolic compound/phenolic resin blend, a low molecular weight phenolic resin/phenolic resin blend, and which phenolic compounds contain at least two, and more specifically, two to ten phenolic groups or low molecular weight phenolic resins with a weight average molecular weight of from about 500 to about 2,000, which can interact with and consume formaldehyde and other phenolic precursors within the phenolic resin effectively, thereby chemically modifying the curing processes for such resins and permitting, for example, a hole blocking layer with excellent efficient electron transport, and which usually results in a desirable lower residual potential and $V_{low}$ for the resulting imaging members.

Aspects of the present invention relate to a photoconductive imaging member comprised of a substrate, a photogenerating layer, and a charge transport layer containing a binder and a compound, monomer, or oligomer containing at least two (methyl)acrylates; a photoconductive imaging member comprised of a substrate, a photogenerating layer, and a charge transport layer comprised of a charge transport component, a binder and a compound containing at least two acrylate segments; a photoconductive imaging member comprised of a supporting substrate, a hole blocking layer thereover, a photogenerating layer and a charge transport layer comprised of hole transport molecules, binder, and a multifunctional acrylate and optionally a top layer comprised of the low dielectric components illustrated herein, such as PPE, PCO, PCT and the like; a photoconductive imaging member wherein the supporting substrate is comprised of a conductive metal substrate; a photoconductive imaging member wherein the conductive substrate is aluminum, aluminized polyethylene terephthalate or a titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in an optional resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging wherein the charge transport aryl amines are, for example, of the formula

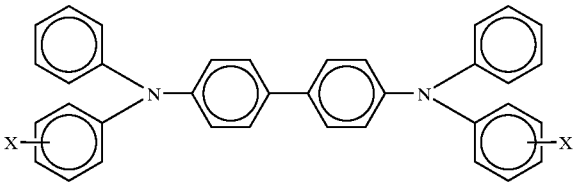

wherein X is selected from the group consisting of alkyl and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or mixtures thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; an imaging member wherein the hole blocking layer phenolic compound is bisphenol S, 4,4'-sulfonyidiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl) methane; an imaging member wherein the phenolic compound is bisphenol M, 4,4'-(1,3-phenylenediisopropylidene) bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member wherein the phenolic compound is hydroxyquinone, 1,4-benzenediol; an imaging member wherein the phenolic compound is of the formula

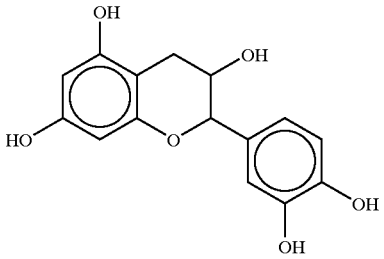

Catechin an imaging member wherein the phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; and a formaldehyde polymer generated with phenol and p-tert-butylphenol; an imaging member comprised in the sequence of a supporting substrate, a hole blocking layer, an optional adhesive layer, a photogenerating layer, and a multifunctional acrylate containing hole transport layer; an imaging member wherein the adhesive layer is comprised of a polyester with an $M_w$ of about 45,000 to about 75,000, and an $M_n$ of from about 30,000 to about 40,000; an imaging member further containing a supporting substrate comprised of a conductive metal substrate of aluminum, aluminized polyethylene terephthalate or titanized polyethylene terephthalate; an imaging member wherein the photogenerator layer is of a thickness of from about 1 to about 5 microns, and wherein the transport layer is of a thickness of from about 20 to about 65 microns; an imaging member wherein the photogenerating layer is comprised of photogenerating pigments dispersed in a resinous binder in an amount of from about 10 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises suitable known or future developed components, and more specifically, aryl amines, and which aryl amines are molecules of the formula

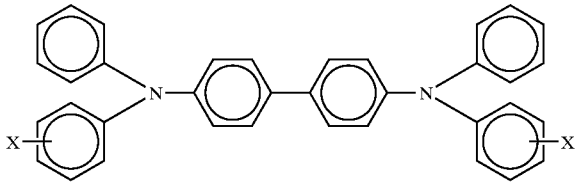

wherein X is selected from the group consisting of alkyl, alkoxy, aryl, and halogen, and the like; and which amines are dispersed in a binder polymer and a multifunctional acrylate polymer; an imaging member wherein the photogenerating layer is comprised of metal phthalocyanines, or metal free phthalocyanines; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; a method of imaging which comprises generating an electrostatic latent image on the imaging member illustrated herein, developing the latent image with a known toner, and transferring the developed electrostatic image to a suitable substrate like paper.

Examples of the multifunctional acrylates include ethylene glycol dimethylacrylate; bisphenol A ethoxylate dimethylacrylate; hexafluorobisphenol A ethoxylate dimethylacrylate; cyclohexane dimethanol dimethacrylate, cyclohexane dimethanol diacrylate, caprolactone modified neopentylglycol hydroxypivalate diacrylate, triethylene glycol dimethacrylate, tetraethylene glycol dimethacrylate, polyethylene glycol (200) dimethacrylate, 1,3 butylene glycol diacrylate, 1,4 butanediol diacrylate, 1,4 butanediol dimethacrylate, diethylene glycol diacrylate, diethylene glycol dimethacrylate, 1,6 hexanediol diacrylate, 1,6 hexanediol dimethacrylate, neopentyl glycol diacrylate, neopentyl glycol dimethacrylate, polyethylene glycol (600) dimethacrylate, polyethylene glycol (200 $M_w$) diacrylate, tetraethylene glycol diacrylate, triethylene glycol diacrylate, 1,3 butylene glycol dimethacrylate, tripropylene glycol diacrylate, polyethylene glycol (400) diacrylate, ethoxylated 2 bisphenol A dimethacrylate, ethoxylated 3 bisphenol A diacrylate, ethoxylated 10 bisphenol A dimethacrylate, dipropylene glycol diacrylate, ethoxylated 6 bisphenol A diacrylate, ethoxylated 4 bisphenol A diacrylate, ethoxylated 10 bisphenol A diacrylate, polyethyiene glycol (400) dimethacrylate, polyethylene glycol (600) diacrylate, propoxylated 2 neopentyl glycol diacrylate, ethoxylated 30 bisphenol A dimethacrylate, di-trimethylolpropane tetramethylacrylate. The aforementioned and other suitable multi-(meth)acrylates are available from Sartomer Company inclusive of polymers with pendant multifunctional acrylate groups. The $M_w$ of the multifunctional acrylates can be, for example, from 100 to 10,000, and more specifically, from about 150 to about 6,000.

Illustrative examples of substrate layers selected for the imaging members of the present invention, and which substrates can be opaque, substantially transparent and the like, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanine, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Aryl amines selected for the charge, especially hole transporting layers, which generally is of a thickness of from about 5 microns to about 75 microns, and more specifically, of a thickness of from about 10 microns to about 40 microns, include molecules of the following formula

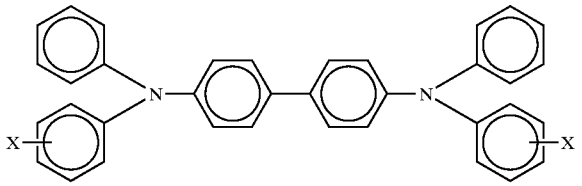

dispersed in a highly insulating and transparent polymer binder, wherein X is an alkyl group, aryl, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

The hole blocking or undercoat layers for the imaging members of the present invention contain a number of components including known hole blocking components, such as silanes, doped metal oxides, TiSi, a metal oxide like titanium, chromium, zinc, tin and the like, a mixture of phenolic compounds and a phenolic resin or a mixture of 2 phenolic resins, and optionally a dopant such as $SiO_2$. The phenolic compounds contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyidiphenol), Z (4,4'-cyclohexylidenebisphenol); hexafluorobisphenol A (4,4'-(hexafluoro isopropylidene) diphenol), resorcinol; hydroxyquinone, catechin, and the like.

The hole blocking layer can be, for example, comprised of from about 20 weight percent to about 80 weight percent, and more specifically, from about 55 weight percent to about 65 weight percent of a metal oxide, such as $TiO_2$, from about 20 weight percent to about 70 weight percent, more specifically, from about 25 weight percent to about 50 weight percent of a phenolic resin, from about 2 weight percent to about 20 weight percent, more specifically, from about 5 weight percent to about 15 weight percent of a phenolic compound preferably containing at least two phenolic groups, such as bisphenol S, and from about 2 weight percent to about 15 weight percent, more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene) bisphenol, such as VARCUM™ 29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Border Chemical).

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same aforementioned sequence with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

Two layered photoreceptors were fabricated by conventional known coating processes. An aluminum drum with a diameter of 34 millimeters was selected as the substrate. The two drum photoreceptors had the same undercoat layer (UCL) and charge generating layer (CGL); one drum photoreceptor contained a crosslinked, about 33 percent, charge transport layer (CTL) and the other drum contained a CTL free of crosslinking.

Photorecegtor Device I

A titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ about 3,600, viscosity about 200 cps) in 7.5 grams of 1-butanol and 7.5 grams of xylene with 120 grams of 1 millimeter diameter sized $Zro_2$ beads for 5 days. Separately, a slurry of $SiO_2$ and a phenolic resin was prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM dispersion. Additional solvents of 5 grams of 1-butanol, and 5 grams of xylene; 2.6 grams of bisphenol S (4,4'-sulfonyldiphenol), and 5.4 grams of the above prepared $SiO_2$/VARCUM slurry were added to 50 grams of the above resulting titanium dioxide/VARCUM dispersion, referred to as the coating dispersion. Then the aluminum drum, cleaned with detergent and rinsed with deionized water, was dip coated with the coating dispersion at a pull rate of 160 millimeters/minute, and subsequently, dried at 160° C. for 15 minutes, which resulted in an undercoat layer (UCL) comprised of $TiO_2$/$SiO_2$/VARCUM/bisphenol S with a weight ratio of about 52.7/3.6/34.5/9.2 and a thickness of 3.5 microns.

A 0.5 micron thick photogenerating layer was subsequently coated on top of the above generated undercoat layer from a dispersion of Type V hydroxygallium phthalocyanine (2.4 grams), alkylhydroxy gallium phthalocyanine (0.6 gram), and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (2 grams), in 95 grams of n-butylacetate.

Subsequently, a 24 μm thick charge transport layer (CTL) was coated on top of the photogenerating layer from a solution of N,N'-diphenyl-N,N-bis(3-methylphenyl)-1,1'-biphenyl-4,4'-diamine (3.6 grams), EGMDA [ethylene glycol dimethacrylate available from Sartomer Company] (1.20 grams), a free radical initiator AIBN [2,2'-azobisisobutyronitrile available from Aldrich Company] (5 milligrams) and a polycarbonate, PCZ-400 [poly(4,4'-dihydroxy-diphenyl-1-1-cyclohexane), $M_w$=40,000 ] available from Mitsubishi Gas Chemical Company, Ltd. (2.40 grams) in a mixture of 21.6 grams of tetrahydrofuran (THF) and 7.2 grams of toluene. The CTL was dried at 120° C. for 45 minutes.

Another photoreceptor drum (Device II) with a 24 μm thick charge transport layer (CTL) was fabricated in the same manner as Device I for comparison purpose. In Device II, the CTL solution contained N,N'-diphenyl-N,N-bis(3-methylphenyl)-1,1'-biphenyl-4,4'-diamine (3.6 grams) and the above polycarbonate PCZ-400 (3.6 grams) in a mixture of 21.6 grams of tetrahydroturan (THF) and 7.2 grams of toluene.

The above devices were electrically tested with an electrical scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photoinduced discharge characteristic (PIDC) curves were obtained from the two different pre-exposed surface potentials, and the data was interpolated into PIDC curves at an initial surface potential of 600 volts. The following table summarizes the electrical performance for these devices.

| Device | S (Volt*cm$^2$/Erg) | $V_r$ (Volt) | $V_{depl}$ (Volt) | $V_{dd}$ (Volt) | $V_{cyc\text{-}up}$ (Volt) | $V_0$ (Volt) |
|---|---|---|---|---|---|---|
| I | 270.1 | 18.2 | −4.6 | −33.6 | 10.3 | 797.3 |
| II | 255.4 | 24.7 | −21.9 | −60.9 | 10.1 | 796.1 |

$V_o$ is the initial charged surface potential of the device, S is the initial slope of the PIDC curve and is a measurement of sensitivity, and $V_{depl}$ is linearly extrapolated from the surface potential versus charge density relation of the device and is a measurement of voltage leak during charging. $V_r$ is the residual potential after light exposure. $V_{dd}$ is the lost potential before light exposure. $V_{cyc\text{-}up}$ is the change of residual potential after 50,000 cycles. In general, an ideal photoreceptor device should have higher sensitivity S and lower $V_r$ while $V_{dd}$, $V_{depl}$ and $V_{cyc\text{-}up}$ should be close to zero. Device I with the crosslinked CTL possessed a more desirable electrical performance than Device II.

The above two devices were then mounted on a wear test imaging fixture to determine the wearing characteristics of each device. After 50,000 cycles, Device I had a wear rate of 56 nanometers per thousand cycles compared with 82 nanometers per thousand cycles for Device II.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A photoconductive imaging member comprised of a substrate, a photogenerating layer, and a charge transport layer containing a binder and a compound, monomer, or oligomer containing at least two (methyl)acrylates.

2. A photoconductive imaging member comprised of a substrate, a photogenerating layer, and a charge transport layer comprised of a charge transport component, a binder and a compound containing at least two acrylate segments.

3. An imaging member in accordance with claim 1 wherein said (methyl)acrylate is cured by a free radical initiator or by UV light.

4. An imaging member in accordance with claim 1 wherein said (methyl)acrylate is cured and crosslinked by heating.

5. An imaging member in accordance with claim 4 wherein said heating is from about 100° C to about 150° C.

6. An imaging member in accordance with claim 4 wherein said heating is from about 100° C. to about 120° C

7. An imaging member in accordance with claim 2 wherein said acrylate is thermally curable.

8. An imaging member in accordance with claim 4 wherein said (methylacrylate)subsequent to curing and being crosslinked possesses a crosslinking value is from about 5 to about 50 percent.

9. An imaging member in accordance with claim 4 wherein said (methylacrylate)subsequent to curing and being crosslinked possesses a crosslinking value is from about 10 to about 30 percent.

10. An imaging member in accordance with claim 1 wherein said acrylate compound is polymerized by heating in the presence of a free radical initiator.

11. An imaging member in accordance with claim 1 wherein said acrylate monomer possesses a weight average molecular weight, $M_w$ of from about 150 to about 10,000, and a number average molecular weight, $M_n$ of from about 100 to about 7,000.

12. An imaging member in accordance with claim 1 wherein said acrylate compound or monomer possesses a weight average molecular weight, $M_w$ of from about 150 to about 6,000, and a number average molecular weight, $M_n$ of from about 150 to about 5,000.

13. An imaging member in accordance with claim 1 wherein said acrylate compound monomer is dispersed in said binder.

14. An imaging member in accordance with claim 1 wherein said acrylate monomer is present in an amount of from about 1 to about 50 percent by weight.

15. An imaging member in accordance with claim 1 wherein said acrylate monomer compound is present in an amount of from about 10 to about 35 percent by weight.

16. An imaging member in accordance with claim 1 wherein said acrylate monomer compound is an ethylene glycol dimethylacrylate.

17. An imaging member in accordance with claim 1 wherein said acrylate monomer compound is a bisphenol A ethoxylate dimethylacrylate.

18. An imaging member in accordance with claim 1 wherein said acrylate monomer compound is a hexafluorobisphenol A ethoxylate dimethylacrylate.

19. An imaging member in accordance with claim 1 wherein said acrylate monomer is cyclohexane dimethanol dimethacrylate, cyclohexane dimethanol diacrylate, caprolactone modified neopantylglycol hydroxypivalate diacrylate, triethylene glycol dimethacrylate, tatraethylene glycol dimethacrylate, polyethylene glycol (200) dimethacrylate, 1,3 butylene glycol diacrylate, 1,4 butanediol diacrylate, and 1,4 butanediol dimethacrylate.

20. An imaging member in accordance with claim 1 wherein said at least two is from about two to about 25.

21. An imaging member in accordance with claim 1 wherein said (methyl)acrylate contains from 2 to about 10 acrylates.

22. An imaging member in accordance with claim 1 wherein said binder is a polycarbonate.

23. An imaging member in accordance with claim 1 further including a hole blocking layer.

24. An imaging member in accordance with claim 23 further including an adhesive layer.

25. An imaging member in accordance with claim 23 wherein said hole blocking layer is comprised of a silane.

26. An imaging member in accordance with claim 23 wherein said hole blocking layer is comprised of a metal oxide.

27. An imaging member in accordance with claim 23 wherein said hole blocking layer is comprised of TiSi.

28. An imaging member in accordance with claim 1 and comprising in sequence a substrate, said photogenerating layer, and said charge transport layer.

29. An imaging member in accordance with claim 1 further including a hole blocking layer of a thickness of about 0.01 to about 10 microns.

30. An imaging member in accordance with claim 1 further containing an adhesive layer.

31. An imaging member in accordance with claim 30 wherein the adhesive layer is comprised of a polyester with an $M_w$ of about 45,000 to about 75,000, and an $M_n$ of from about 30,000 about 40,000.

32. An imaging member in accordance with claim 1 wherein said substrate is comprised of a conductive metal substrate of aluminum, aluminized polyethylene terephthalate or titanized polyethylene terephthalate.

33. An imaging member in accordance with claim 1 wherein said photogenerator layer is of a thickness of from about 0.05 to about 10 microns, and wherein said transport layer is of a thickness of from about 20 to about 70 microns.

34. An imaging member in accordance with claim 1 wherein said photogenerating layer is comprised of a photogenerating pigment or photogenerating pigments dispersed in a resinous binder, and wherein said pigment or pigments are present in an amount of from about 5 percent by weight to about 95 percent by weight, and wherein the resinous binder is optionally selected from the group comprised of vinyl chloride/vinyl acetate copolymers, polyesters, polyvinyl butyrals, polycarbonates, polystyrene-b-polyvinyl pyridine, and polyvinyl formulas.

35. An imaging member in accordance with claim 1 wherein the charge transport layer comprises aryl amines, and which aryl amines are of the formula

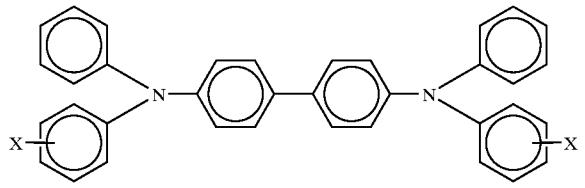

wherein X is selected from the group consisting of alkyl and halogen.

36. An imaging member in accordance with claim 35 wherein alkyl contains from about 1 to about 12 carbon atoms.

37. An imaging member in accordance with claim 35 wherein the aryl amine is N,N'-diphenyl-N,N-bis(3methyl phenyl)-1,1'-biphenyl-4,4'-diamine.

38. An imaging member in accordance with claim 1 wherein the photogenerating layer is comprised of metal phthalocyanines, or metal free phthalocyanines.

39. An imaging member in accordance with claim 1 wherein the photogenerating layer is comprised of titanyl phthalocyanines, perylenes, or hydroxygallium phthalocyanines.

40. An imaging member in accordance with claim 1 wherein the photogenerating layer is comprised of Type V hydroxygallium phthalocyanine.

41. A method of imaging which comprises generating an electrostatic latent image on the imaging member of claim 1, developing the latent image, and transferring the developed electrostatic image to a suitable substrate.

42. An imaging member in accordance with claim 1 wherein said photogenerating layer is of a thickness of from about 1 to about 10 microns.

43. An imaging member in accordance with claim 1 wherein said photogenerating layer is of a thickness of from about 1 to about 5 microns.

44. An imaging member in accordance with claim 1 wherein said charge transport layer is of a thickness of from about 5 to about 75 microns.

45. An imaging member in accordance with claim 1 wherein said charge transport binder is a polycarbonate, a vinyl polymer, or polyester.

46. An imaging member in accordance with claim 1 wherein said acrylate is present in an amount of from about 1 to about 50 percent by weight, said photogenerating layer contains a photogenerating pigment present in an amount of from about 30 to about 70 percent by weight, said binder is present in an amount of from about 1 to about 60 percent by weight, said photogenerating layer is of a thickness of from about 0.05 microns to about 10 microns, said charge transport layer is of a thickness of from about 5 to about 75 microns, and said substrate is of a thickness of from about 1 to about 3,000 microns.

47. An imaging member in accordance with claim 1 wherein said acrylate is present in an amount of from about 10 to about 35, said photogenerating layer contains a photogenerating pigment present in an amount of from about 35 to about 50 percent by weight, said binder is present in an amount of from about −20 to about −40 percent by weight, said photogenerating layer is of a thickness of from about −0.25 to about 2 microns, said charge transport layer is of a thickness of from about 25 microns; and said substrate is of a thickness of from about 75 to about 300 microns.

48. A photoconductive imaging member comprised of a photogenerating layer, and a charge transport layer containing a binder and a multifunctional acrylate of EGDMA, bis-EMA, or F-Bis-EMA of

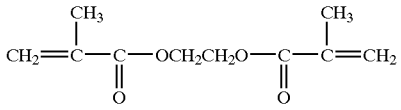

EGDMA

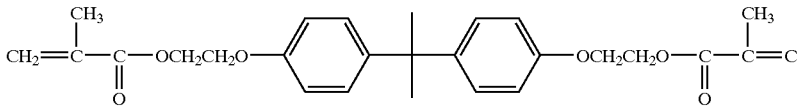

Bis-EMA

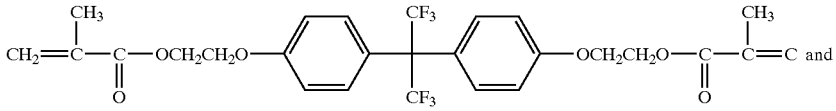

and

F-bis-EMA

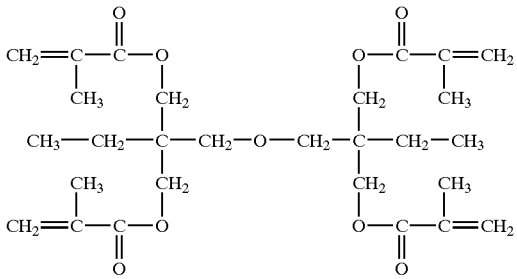

DP-PMA and optionally which acrylate is polymerized.

49. An imaging member in accordance with claim 1 wherein said acrylate contains two acrylate segments or units.

50. An imaging member in accordance with claim 1 wherein said acrylate contains from 2 to about 200 acrylates.

51. An imaging member in accordance with claim 1 wherein said acrylate contains from about 2 to about 50 acrylate segments.

52. A photoconductive imaging member comprised of a substrate, a photogenerating layer, and a charge transport layer containing a binder and a compound, monomer, or oligomer containing at least two (methyl)acrylates, and wherein said monomer is polymerized by heating and thereby resulting in a crosslinked polymer.

* * * * *